US005386664A

United States Patent [19]

Lumenello

[11] Patent Number: 5,386,664

[45] Date of Patent: Feb. 7, 1995

[54] WINDOW SECURITY SYSTEM

[75] Inventor: Peter Lumenello, Lowell, Mass.

[73] Assignee: Anthony L. Lumenello, Malden, Mass.

[21] Appl. No.: 117,244

[22] Filed: Sep. 7, 1993

Related U.S. Application Data

[63] Continuation of Ser. No. 913,306, Jul. 14, 1992, abandoned.

[51] Int. Cl.[6] ..... E05D 15/06

[52] U.S. Cl. ..... 49/404; 49/453; 292/D46; 292/288

[58] Field of Search ..... 49/453, 454, 404, 463; 292/D46, 288, D47

[56] References Cited

U.S. PATENT DOCUMENTS

| | | | |
|---|---|---|---|
| 3,714,738 | 2/1973 | Koslow et al. | 49/404 |
| 4,062,576 | 12/1977 | Jennings et al. | 292/258 |
| 4,208,755 | 6/1980 | Shepherd | 49/404 |
| 4,208,841 | 6/1990 | Starks | 292/343 |
| 4,314,719 | 2/1982 | Hawkins | 292/DIG. 46 |
| 4,526,412 | 7/1985 | Gist | 292/300 |
| 4,530,531 | 7/1985 | Mantini | 292/DIG. 46 |
| 4,656,781 | 4/1987 | Niekrasz et al. | 49/404 |
| 4,875,349 | 10/1989 | Girard | 292/DIG. 46 |
| 4,971,374 | 11/1990 | Lovell et al. | 292/DIG. 46 |
| 4,993,761 | 2/1991 | Paskert | 292/288 |
| 5,015,022 | 5/1991 | McGuire | 292/DIG. 46 |
| 5,065,544 | 11/1991 | Martin | 49/453 |

FOREIGN PATENT DOCUMENTS

| | | | |
|---|---|---|---|
| 2274769 | 2/1976 | France | 49/404 |

*Primary Examiner*—Michael J. Milano
*Attorney, Agent, or Firm*—Lahive & Cockfield

[57] ABSTRACT

The window security system is provided for conventional horizontally sliding double slash doors and/or windows. The security system includes a removable and replaceable security member which is mountable upon a top portion of the inner sash to prevent the inner sash from being raised a sufficient distance within its channel to be removed from the channel.

6 Claims, 3 Drawing Sheets

WINDOW SECURITY SYSTEM

This application is a continuation of application Ser. No. 913,306, filed on Jul. 14, 1992 now abandoned.

BACKGROUND OF THE INVENTION

The invention relates to window security systems which protect sliding windows and doors from entry by unauthorized intruders.

Sliding windows and doors are commonly used in residential dwellings and in commercial establishments. These windows and doors are attractive, functional and convenient to install. However, the ease with which these windows are installed limits the amount of security provided by such windows and doors.

Sliding horizontal windows and doors are constructed to be easily removable from their frame. To remove such a window or door, the inner sash is simply raised within the header (top) channel until the bottom of the sash clears a divider wall forming an inner portion of the rim of the bottom channel. Thereafter, the bottom of the sash is pivoted inwardly to completely remove the window. The outer sash can then be removed in the same manner.

A drawback of such window and door constructions is that an intruder can easily remove the window or door from outside in the manner described above, and gain entry to the dwelling. Traditional window locks, when engaged, generally prevent removal of the sashes. However, there are many times when the window or door is not locked and when it is necessary to allow the window and doors to remain open for purposes of ventilation. One technique for attempting to secure such windows and doors is to place a dowel within the channel to prevent full opening of the sash. This is not completely effective since one can still lift and entirely remove the sash from the frame.

It is thus an object of the invention to provide an effective window security system which prevents the removal of horizontal sliding windows and doors. A further object is to provide such a security system which does not interfere with the operation of the window. Other objects of the invention will be apparent upon reading the disclosure which follows.

SUMMARY OF THE INVENTION

The window security system of the invention comprises a conventional horizontal, double sash sliding window assembly modified to prevent unauthorized removal of the window from the outside. The system comprises a window frame and the inner and outer sliding sashes that fit within the frame. A removable and replaceable locking member is adapted to be secured to a top portion of the inner sash so as to extend within the header (top) channel of the window frame. The locking member has dimensions which are sufficient to prevent the inner sash from being raised within the inner channel of the window frame to a height which allows the inner sash to be removed from the channel. Preferably, locking member is L-shaped with the shorter arm of the member being adapted to be secured to a side of the sash frame and the longer arm being adapted to be mounted atop the sash frame. A fastening mechanism is preferably used to maintain the locking member in position.

While the present invention is equally applicable to double sash sliding doors and windows, the invention will be described primarily with reference to windows.

It is understood, however, that the scope of the invention encompasses both windows and doors.

DETAILED DESCRIPTION OF THE INVENTION

The window security system 10 of the present invention is adapted for use with a conventional horizontally sliding double sash window or door system. The window security system 10 of the invention improves the security of such windows and doors by preventing unauthorized entry to a dwelling from the outside by an intruder who is simply able to lift and remove the inner and/or outer window sashes.

Figure 1:
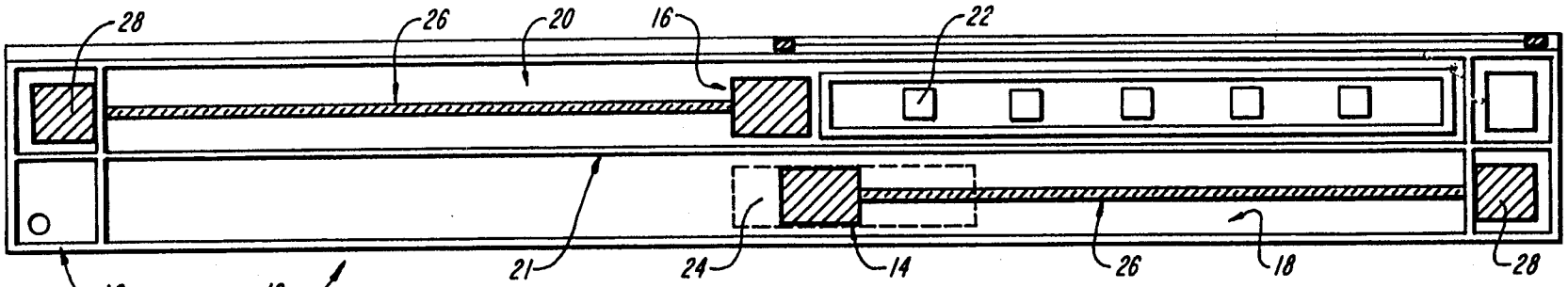
FIG. 1 is a top view of a window security system constructed according to the present invention.
Figure 4:
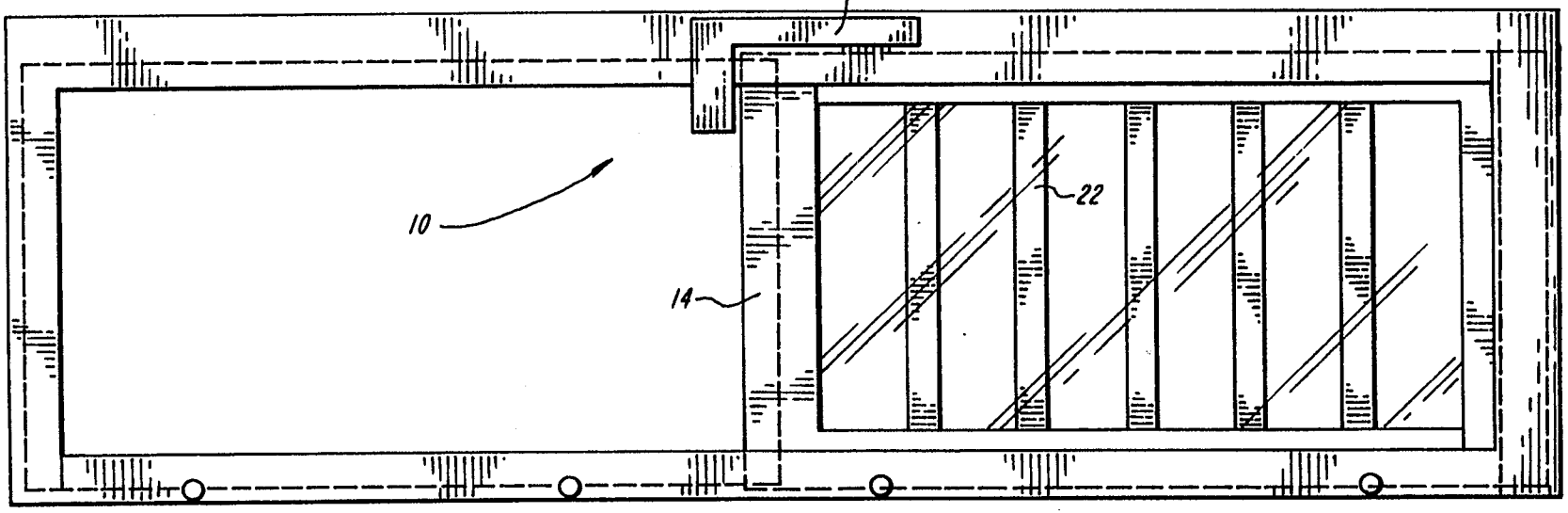
FIG. 4 is a front view (from the inside looking out) of a double sash sliding window equipped with the window security system of the present invention.
Figure 2:
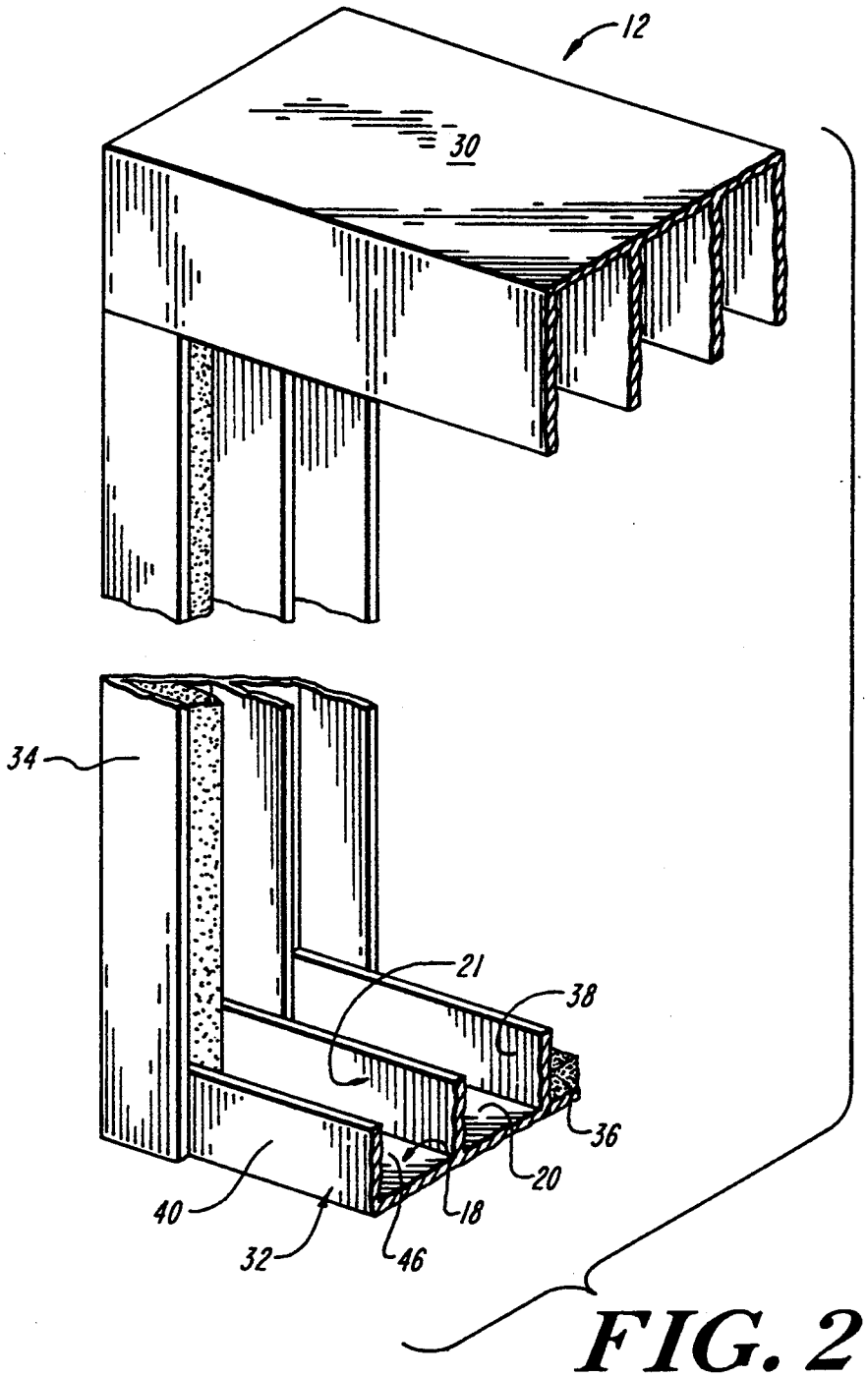
FIG. 2 is a partial perspective view of a prior art window frame useful with the present invention.

As illustrated in FIGS. 1, 2, and 4, the window system 10 of the invention comprises a frame 12, an inside slider sash 14, an outside slider sash 16, and a security block 24. The inside slider sash is disposed within an inside channel 18 while the outside slider sash 16 is disposed within an outside channel 20. Security block 24 is mounted within inside channel 18, atop the inside slider sash 14. Each sliding window sash 16, 18 comprises a glass pane 26 mounted within a sash frame 28.

FIG. 2 further illustrates the frame 12 of a horizontal sliding double sash window. As illustrated, frame 12 comprises a header channel 30 which forms an upper part of the frame 12. The bottom channel 32 is joined to the header channel 30 by side channels 34 (only one of which is illustrated) which join the header and bottom channels. Inside channel 18 and outside channel 20 are adjacent to each other within the frame and define the inner circumference of the frame. Inner and outer channels 18, 20 are separated by channel divider 21. Optionally, a screen channel 36 may be adjacent to and disposed outwardly from outside channel 20. Screen channel 36 preferably is separated from outside channel 20 by channel divider 38.

The inner channel 18 is adapted to house an inner window sash while the outside channel is adapted to house an outer window sash. The dimensions of window or door frames and channels will vary depending upon the window or door styles and sizes. The appropriate dimensions suitable for use with a given style or size window or door are well known in the art. By way of example, and to further illustrate the invention, dimensions will be provided for a conventional horizontal, double sash sliding window. In such a window, the bottom and side channels are approximately $\frac{3}{4}$ inch deep while the header channel is approximately $1\frac{1}{8}$ inch deep. Channel dividers 21 and 38 can also be approximately $\frac{3}{4}$ inch in height as measured from the bottom of the bottom channel 32.

Optionally, as shown in FIGS. 1 and 4, a security grille 22 may be placed within outside channel 20, adjacent to outside slider sash 16, to prevent the outside slider sash from being moved horizontally. Such a security grille reduces the chances of unauthorized entry through the window or door. A suitable security grille is disclosed in U.S. Pat. No. 4,593,492 which is incorporated herein by reference.

As noted, security block 24 is removably and replaceably secured atop portion of the sash frame 28 of the inner sash 14 such that it occupies a portion of header channel 30. The security block 24 prevents the inside slider sash from being raised by a sufficient amount to allow it to clear inner wall 46 of inside channel so as to be removed from the frame 12. Thus, the security block 24 increases the security of sliding double sash windows and doors by preventing easy access to a premises by simple removal of the window sash.

Figure 3A:
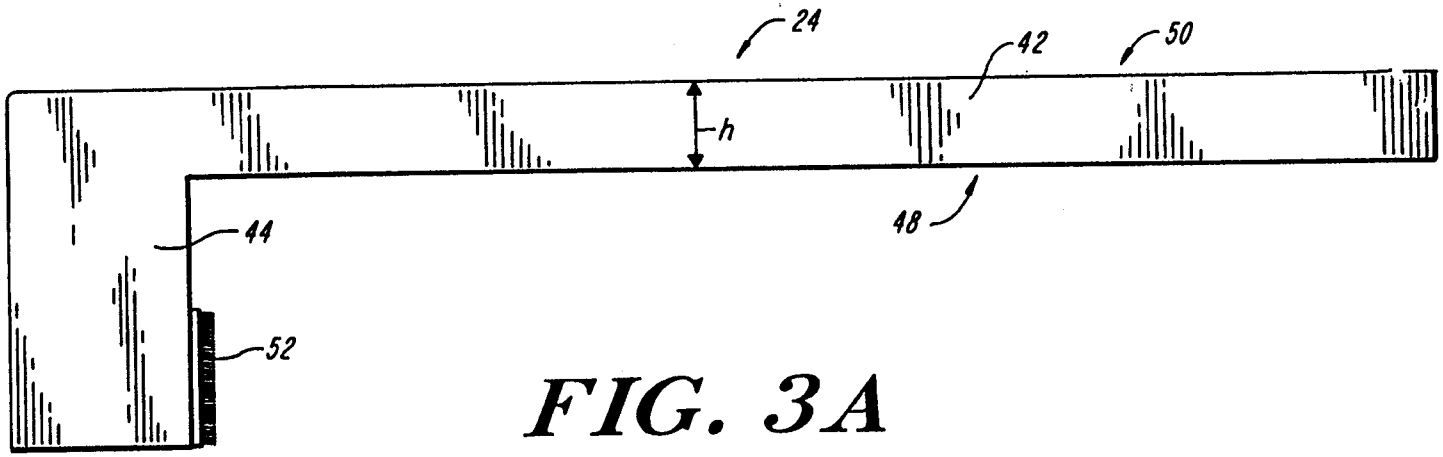
FIGS. 3A and 3B are side views and perspective views, respectively, of a locking member useful with the present invention.
Figure 3B:
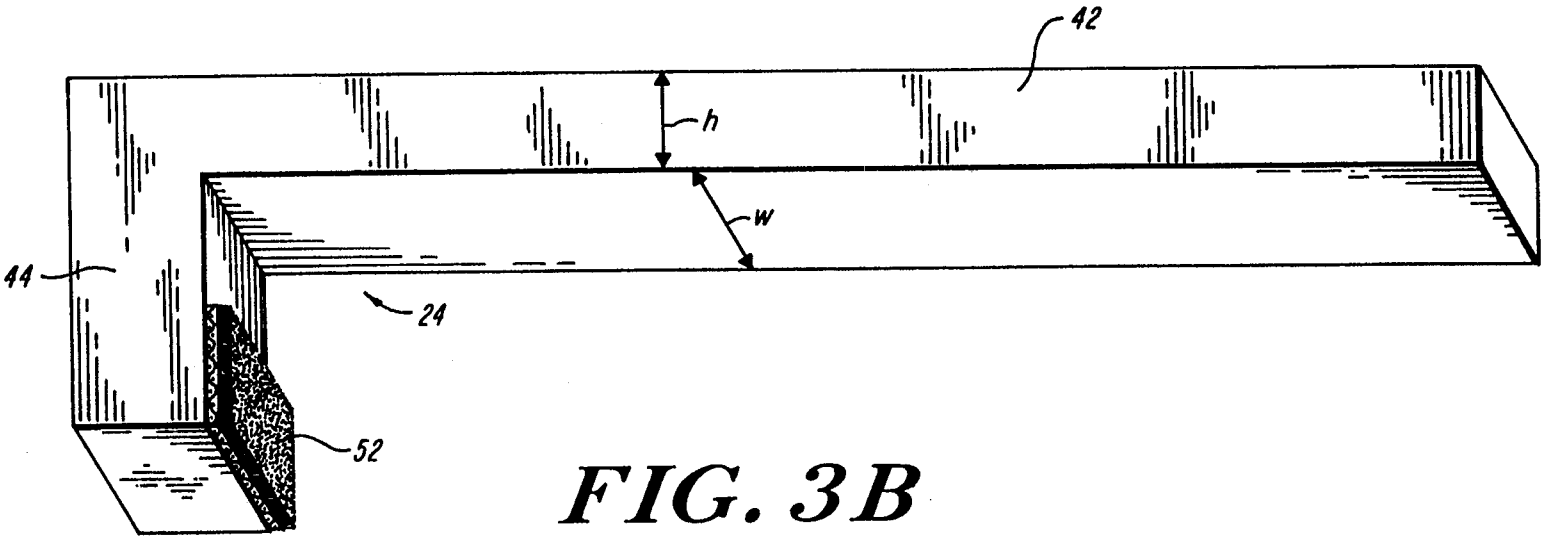

FIGS. 3A and 3B illustrate an exemplary construction of security block 24 useful with the present invention. Block 24 is a substantially L-shaped member having a long arm or portion 42 and a shorter arm or portion 44. Arms 42 and 44 are preferably oriented at right angles to one another. Block 24 has an inner surface 48 which preferably mates against sash frame 28, and an outer surface 50. The inner surface 48 of arm 44 preferably includes a fastening device 52 which allows the block to be removably and replaceably secured to sash frame 28. A variety of fastening devices can be used to removably and replaceably secure the block to the sash frame. In a preferred embodiment, the fastening device is a hook-and-needle fastening system, such as VELCRO.

The dimensions of security block 24 may be varied to some extent while still being effective to prevent the removal of inside sash 14. The height (h) of block 24 must be great enough to prevent inside sash 14 from being raised within header channel 30 to an extent sufficient to allow a bottom portion of the inside sash 16 to clear inner wall 46 of the inside channel. Clearly, the dimensions of block 24 will depend upon the depth of both the bottom channel and the header channel. In a preferred embodiment, however, where the header channel is approximately $1\frac{1}{8}$ inch deep, and the bottom channel is approximately $\frac{3}{4}$ inch deep, the height (h) of block 24 is approximately $\frac{1}{2}$ inch.

Similarly, the width (w) of block 24 will vary depending upon the width of the channels and the width of the sash frame 28. In a preferred embodiment, the width (w) of block 24 is substantially equal to that of sash frame 28.

FIG. 4 further illustrates the window security system of the invention where both the outside and inside sashes 16, 18 are shown in the closed position. Security block 24 is mounted atop inside sash 16 such that longer arm 42 of the block abuts a top portion of sash frame 28, and a shorter arm 44 of the block abuts a side portion of sash frame 28. Preferably, the block 24 is disposed on a portion of sash frame 28, closest in proximity to the center of the window opening.

As noted, the block 24 preferably is removably and replaceably secured to the inside sash by a variety of fastening devices, including adhesive means or by hook-and-needle type fasteners. In a preferred embodiment, a hook-and-needle type fastening device, such as VELCRO, is utilized. Preferably a first portion 54 of the mating device is disposed on inside surface 48 of arm 44. The fastening device 54 mates with a corresponding fastening device 56 preferably mounted on a side portion of window sash 28.

When the security block 24 is properly positioned in the window system, as illustrated in FIGS. 1 and 4, it is not possible to remove the inner sash 16 from window frame 12. As a result, outside sash 16 is also incapable from being removed from the window frame 12. Since the inside sash 14 cannot be removed from the window frame 12, it is difficult if not impossible to achieve unauthorized entry through the window opening from the outside of the dwelling. Security grille 22 can be mounted outside of inner sash 16 and adjacent to outer sash 18 to prevent passage through the window opening when the inner sash 16 is in the open position.

Although the present security system is described primarily with respect to sliding double sash windows, the system is also applicable to sliding glass doors. The construction of the security block 24 remains virtually the same for use with sliding glass doors, however minor dimensional adjustments, which would be appreciated by one of ordinary skill in the art may need to be made. Additional modifications may also be made to the invention without departing from its intended scope.

What is claimed is:

1. A sliding window assembly, comprising:

an outside window sash slidably mounted within an outside channel of a window frame for horizontal movement:

an inside window sash slidably mounted within an inside channel of a window frame for horizontal movement:

a window frame having inside and outside channels encircling the frame and housing the inner and outer window sashes, the top portion of each channel having a depth greater than the side and bottom portions of each channel sufficient to allow window sashes mounted within the channels to be lifted within the upper channel such that a bottom portion of each window sash is able to be removed from a bottom portion of the channel to allow the window sash to be removed from the window frame; and a locking member consisting of an L-shaped member having a long portion and a short portion integrally joined at substantially a right angle to each other, the member being removably and replaceably mountable by hand to a top portion of the inner sash, at a portion of the inner sash proximal to a central point of the window frame, the long portion of the member being mountable against the top portion of the inner sash, within the upper portion of the inner channel and having a height sufficient to prevent the inner sash from being raised within the top portion of the inner channel to a height sufficient to allow removal of the inner sash from the channel while still allowing normal sliding operation of the window sash.

2. The assembly of claim 1 wherein the member includes a means for removably and replaceably fastening the member to the sash.

3. The assembly of claim 2 wherein the means for removably and replacing the fastening member to the sash is secured to the inner surface of the short portion of the member.

4. The assembly of claim 3 wherein the means for removably and replaceably fastening the member comprises a first hook or needle pad securely mounted on an inner surface of the short portion of the member and a second hook and needle pad, mateable with the first hook and needle pad, securely mounted upon the window sash and adapted to engage the first hook and needle pad.

5. The assembly of claim 1 wherein the inner and outer channels are approximately $\frac{3}{4}$ inch deep at side and bottom portions thereof, and about 1 and $\frac{1}{8}$ inch deep at a top portion thereof.

6. The assembly of claim 5 wherein the height of the member is approximately $\frac{1}{2}$ inch.

* * * * *